US009828126B2

(12) United States Patent
Robinson et al.

(10) Patent No.: US 9,828,126 B2
(45) Date of Patent: Nov. 28, 2017

(54) TRACK ASSEMBLY FOR BUNDLING ONE OR MORE OBJECTS AND METHODS TO USE THE SAME

(71) Applicant: Enterprises International, Inc., Hoquiam, WA (US)

(72) Inventors: Darrell Robinson, Montesano, WA (US); Donald Smith, Aberdeen, WA (US); Lyndon Cozzutto, Aberdeen, WA (US); Philip Floyd Jones, Hoquiam, WA (US)

(73) Assignee: Enterprises International, Inc., Hoquiam, WA (US)

( * ) Notice: Subject to any disclaimer, the term of this patent is extended or adjusted under 35 U.S.C. 154(b) by 1028 days.

(21) Appl. No.: 13/941,285

(22) Filed: Jul. 12, 2013

(65) Prior Publication Data

US 2014/0013969 A1 Jan. 16, 2014

Related U.S. Application Data

(60) Provisional application No. 61/671,034, filed on Jul. 12, 2012, provisional application No. 61/818,368, filed on May 1, 2013.

(51) Int. Cl.

| | |
|---|---|
| ***B65B 13/06*** | (2006.01) |
| ***B65B 13/22*** | (2006.01) |
| ***B65B 13/04*** | (2006.01) |
| ***B65B 13/28*** | (2006.01) |

(52) U.S. Cl.

CPC ..... *B65B 13/04* (2013.01); *B65B 13/06* (2013.01); *B65B 13/22* (2013.01); *B65B 13/28* (2013.01)

(58) Field of Classification Search

CPC ..... B65B 13/00; B65B 13/04; B65B 13/06; B65B 13/10; B65B 13/22; B65B 13/28

USPC ..... 100/26; 53/589

See application file for complete search history.

(56) References Cited

U.S. PATENT DOCUMENTS

| | | | | |
|---|---|---|---|---|
| 1,486,396 A | | 3/1924 | Ingold | |
| 3,146,695 A | | 9/1964 | Van De Bilt | |
| 3,179,037 A | | 4/1965 | Cranston, Jr. et al. | |
| 3,327,618 A | | 6/1967 | Cook | |
| 3,447,448 A | | 6/1969 | Pasic | |
| 3,759,169 A | * | 9/1973 | Goodley | B65B 13/02 100/26 |

(Continued)

FOREIGN PATENT DOCUMENTS

| | | | | |
|---|---|---|---|---|
| GB | 2267075 A | * | 11/1993 | B65B 13/06 |
| WO | 2010/001345 A2 | | 1/2010 | |

*Primary Examiner* — Jimmy T Nguyen

(74) *Attorney, Agent, or Firm* — Seed IP Law Group LLP

(57) ABSTRACT

A track system, for use in connection with bundling one or more objects positioned within a bundling station, includes guiding a length of wire through a track guide assembly. The track guide assembly includes a plurality of straight and corner track segments coupled to each other and to a carrier plate subassembly, the track guide assembly substantially enclosing a wire guide path to guide the length of wire about the one or more objects. The track system further includes a pneumatic system configured to reduce a pressure to release the plurality of straight and corner track segments to free the length of wire during a tension cycle and to increase the pressure to fix the plurality of straight and corner track segments during a feed cycle. Related systems and methods are also provided.

8 Claims, 4 Drawing Sheets

(56) References Cited

U.S. PATENT DOCUMENTS

| | | | | | |
|---|---|---|---|---|---|
| 3,831,512 | A | * | 8/1974 | Johnson | B65B 13/06 100/26 |
| 3,889,584 | A | | 6/1975 | Wiklund | |
| 4,403,542 | A | | 9/1983 | Lewis | |
| 4,450,763 | A | | 5/1984 | Saylor | |
| 4,498,379 | A | | 2/1985 | Saylor | |
| 4,520,720 | A | * | 6/1985 | Urban | B65B 13/06 100/26 |
| 4,711,071 | A | * | 12/1987 | Kagi | B65B 13/06 100/26 |
| 5,333,438 | A | * | 8/1994 | Gurak | B65B 13/20 100/24 |
| 5,916,108 | A | | 6/1999 | Drietz et al. | |
| 6,499,525 | B1 | * | 12/2002 | Lai | B65B 13/185 100/26 |
| 6,584,891 | B1 | | 7/2003 | Smith et al. | |
| 2003/0024404 | A1 | | 2/2003 | Daniel et al. | |
| 2003/0121424 | A1 | | 7/2003 | Doyle et al. | |
| 2005/0224131 | A1 | | 10/2005 | Ishii et al. | |

* cited by examiner

TRACK ASSEMBLY FOR BUNDLING ONE OR MORE OBJECTS AND METHODS TO USE THE SAME

CROSS-REFERENCE TO RELATED APPLICATION

This application claims the benefit under 35 U.S.C. §119 (e) of U.S. Provisional Patent Application No. 61/671,034, filed Jul. 12, 2012, and U.S. Provisional Patent Application No. 61/818,368, filed May 1, 2013, and where these provisional applications are incorporated herein by reference in their entirety.

BACKGROUND

Technical Field

The present disclosure relates to systems and methods for bundling one or more objects and, more particularly, to track assemblies for guiding a length of wire around a bundle of one or more objects.

Description of the Related Art

U.S. Pat. No. 6,584,891 ('891 patent) issued to Smith et al., teaches apparatuses and methods for wire-tying one or more objects and is incorporated herein by reference in its entirety. The '891 patent teaches a track guide assembly that guides a length of wire around one or more objects positioned in a bundling station. The track guide assembly of the '891 patent includes non-segmented, unitary straight and corner sections that form a wire guide path around one or more objects positioned in the bundling station. More particularly, the track guide assembly of the '891 patent teaches a system for guiding the length of wire around the wire guide path that passively releases the length of wire during a tension cycle, as tensile forces are exerted on the length of wire.

BRIEF SUMMARY

This application is an improvement over U.S. Pat. No. 6,584,891. Embodiments described herein provide systems and methods for guiding a length of wire around a bundle of one or more objects. According to one embodiment, a track system for use in connection with bundling one or more objects positioned within a bundling station may be summarized as including: a carrier plate subassembly extending around a wire guide path; a plurality of straight track segments coupled to the carrier plate subassembly; and a plurality of corner track segments coupled to the carrier plate subassembly and the plurality of straight track segments to form a track guide assembly, the track guide assembly substantially enclosing the wire guide path to guide a length of wire about the one or more objects. The track system may further include a pneumatic system in fluid communication with a regulated pressure source and a pressure release valve and fluidically coupled to the track guide assembly, the pneumatic system being configured to release pressure to allow the plurality of straight and corner track segments to free the length of wire during a tension cycle and to increase the pressure to fix the plurality of straight and corner segments to secure the length of wire to pass therethrough during a feed cycle.

According to another embodiment, a system to guide a length of wire through a track assembly may be summarized as including: a track guide assembly operable between a released and a clamped position and a pneumatic system. The track guide assembly may include a plurality of straight track segments; a plurality of curved corner track segments may be affixed or coupled to the plurality of straight track segments; a carrier plate subassembly affixing or coupling the plurality of straight track segments and the plurality of curved corner track segments thereto to form a wire guide path; and a pneumatic hose contained within the carrier plate subassembly. The pneumatic system is fluidically coupled to a regulated pressure source, a pressure release valve, and the pneumatic hose, wherein the pneumatic system is configured to pressurize the pneumatic hose such that the track guide assembly is in the clamped position during a feed cycle and, wherein, the pneumatic system is configured to depressurize the pneumatic hose such that, during a tension cycle, the track guide assembly is opened by the length of wire as the length of wire is drawn out of the track guide assembly and onto the bundle of one or more objects.

According to yet another embodiment, a method to guide a length of wire through a track guide assembly operable between a clamped and a released position may be summarized as including: pressurizing a pneumatic hose to fix the track guide assembly in the clamped position; feeding the length of wire along the track guide assembly; and releasing pressure within the pneumatic hose to allow the track guide assembly to move into the released position as the length of wire is tensioned.

DETAILED DESCRIPTION

The following detailed description is directed toward track assemblies for guiding a length of wire around a bundle of one or more objects positioned in a bundling station, and methods for using the same. The following detailed description and corresponding figures are intended to provide an individual of ordinary skill in the art with enough information to enable that individual to make and use embodiments of the invention. Such an individual, however, having read this entire detailed description and reviewed the figures, will appreciate that modifications can be made to the illustrated and described embodiments, and/or elements removed therefrom, without deviating from the spirit of the invention. It is intended that all such modifications and deviations fall within the scope of the invention, to the extent they are within the scope of the associated claims.

Unless the context requires otherwise, throughout the specification and claims which follow, the word "comprise"

and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
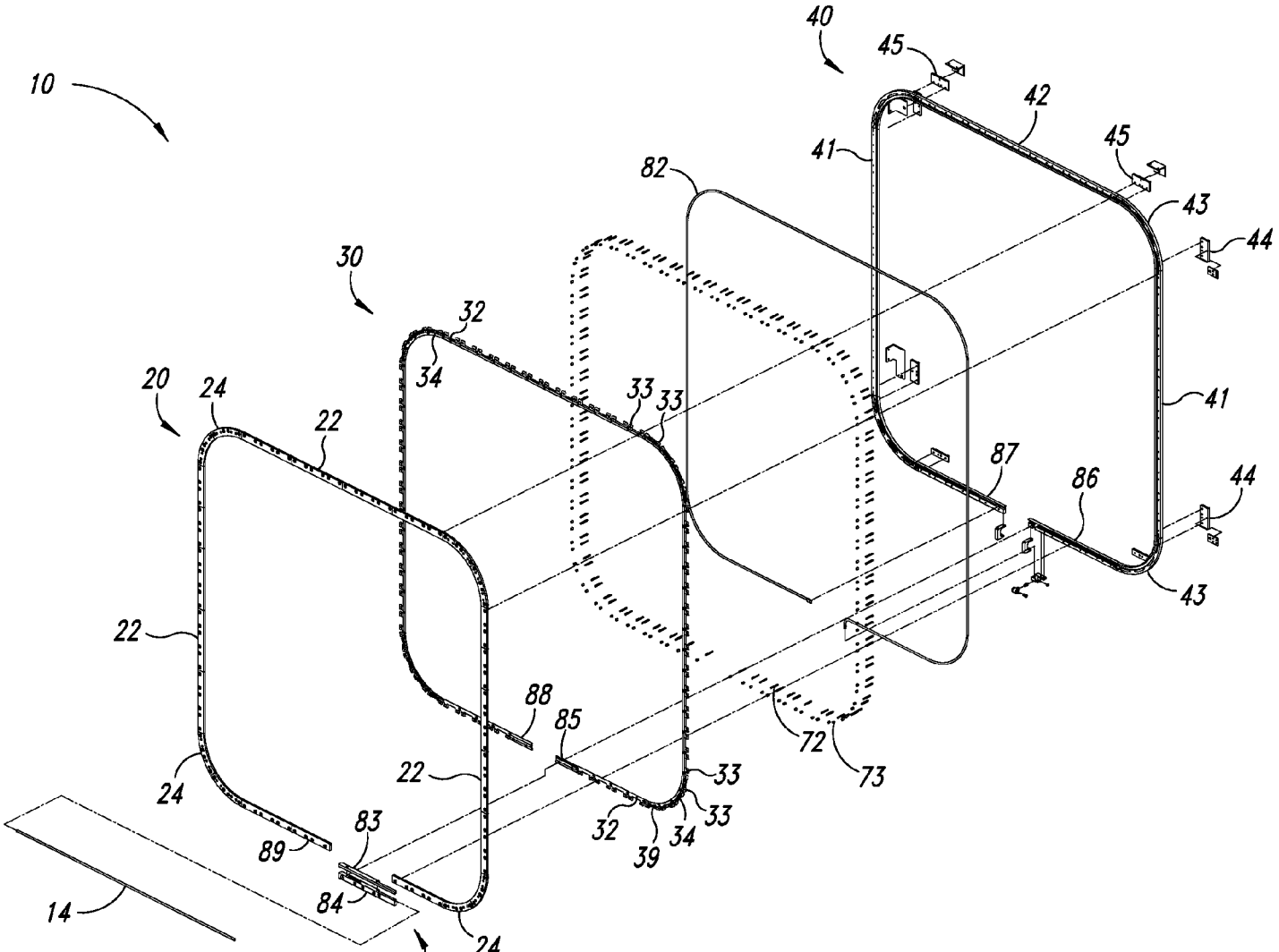
FIG. 1 is an exploded isometric view of a track assembly of a wire-tying machine, according to one embodiment.

FIG. 1 is an exploded view of a track guide assembly 10. The track guide assembly 10 primarily includes a cover plate subassembly 20, an insert subassembly 30, a carrier plate subassembly 40, a track entry and exit subassembly 80, and a pneumatic hose 82.

Figure 2B:
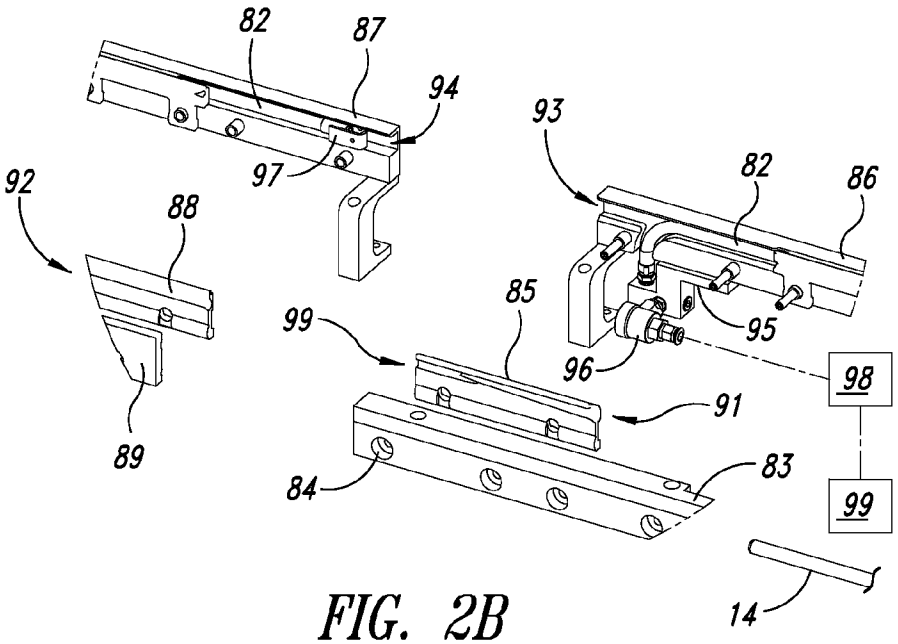
FIG. 2B is an enlarged isometric partial view of the feed tube subassembly shown with the entry and exit segments of the track assembly of FIG. 1.
Figure 2A:
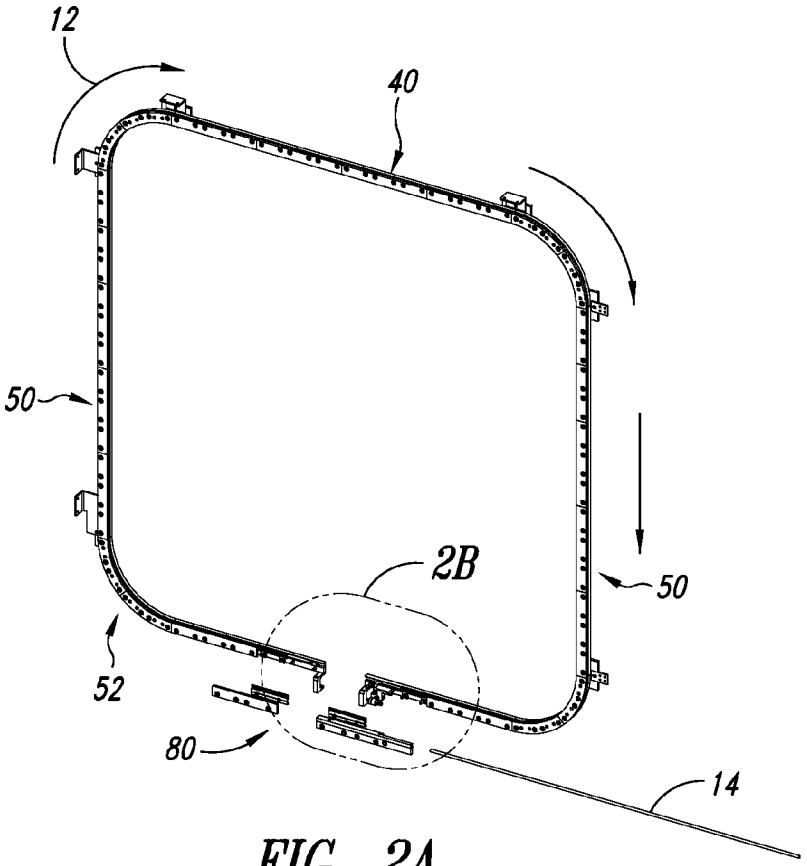
FIG. 2A is an isometric view of the track assembly of FIG. 1 shown with a feed tube subassembly.

With reference to FIG. 1, the illustrated cover plate subassembly 20 includes a plurality of straight cover plates 22 abutting each other to form a portion of an outer perimeter, the outer perimeter reflecting a wire guide path 12 (FIG. 2A). To complete the portion of the outer perimeter and to provide a smooth turn radius, a plurality of curved corner cover plates 24 are provided. The corner cover plates 24 couple the plurality of straight cover plates 22 that are oriented in a substantially perpendicular manner, thus completing the outer perimeter.

Similar to the cover plate subassembly 20, the illustrated insert subassembly 30 includes a plurality of straight inserts 32 abutting each other to form the portion of the outer perimeter reflecting the wire guide path 12. To complete the portion of the outer perimeter and to provide a smooth turn radius, a plurality of curved corner inserts 34 are provided. The corner inserts 34 couple the plurality of straight inserts 32 that are oriented in a substantially perpendicular manner, thus completing the outer perimeter. The straight and the corner inserts 32, 34 may advantageously be made from stainless steel or other corrosion resistant materials to improve corrosion resistance, wear resistance, and coefficient of friction properties.

The illustrated carrier plate subassembly 40 includes a pair of substantially parallel vertical carrier plates 41, a horizontal carrier plate 42 (which is substantially perpendicular to the pair of vertical carrier plates 41), and a plurality of corner carrier plates 43. The corner carrier plates 43 abut the vertical carrier plates 41 and the horizontal carrier plate 42. A plurality of vertical track connectors 44 and a plurality of horizontal track connectors 45 couple the corner carrier plates 43 to the vertical carrier plates 41 and the horizontal carrier plate 42, thereby forming the portion of the outer perimeter reflecting the wire guide path 12. Although the illustrated embodiment of the carrier plate subassembly 40 includes a pair of vertical carrier plates 41, a horizontal carrier plate 42, and a plurality of unitary corner carrier plates 43, a person of ordinary skill in the relevant art will immediately appreciate, after reviewing the entire disclosure, that similar to the cover plate subassembly 20 and the insert subassembly 30, the pair of vertical carrier plates 41, the horizontal carrier plate 42, and the plurality of unitary corner carrier plates 43 may each be formed from a plurality of respective, segmented plates.

With reference to FIGS. 1 and 2, each straight cover plate 22 is coupled to the straight insert 32 to form a straight track segment 50. Similarly, each corner cover plate 24 is coupled to the corner insert 34 to form a corner track segment 52. Each straight track segment 50 and each corner track segment 52 is further coupled to the carrier plate subassembly 40, with a pneumatic hose 82 sandwiched therebetween, through fastening means 72, such as bolts, fasteners, screws or the like. Advantageously, the straight track segments 50 and the corner track segments 52 may be of equal length, thus allowing for cost-effective replaceability of worn parts. Further, having equal length straight and corner segments 50, 52 allows for efficient extension or reduction of the wire guide path 12 by adding or removing straight track segments 50.

With continued reference to FIGS. 1 and 2, a feed tube 14 feeds a free end of a length of wire 102 through a feed wire slot 99 in a known manner to the track entry and exit subassembly 80. The track entry and exit subassembly 80 primarily includes a track entry top 83, which is secured to a track entry bottom 84, a track entry insert 85, an entry hose carrier 86, an exit hose carrier 87, a track exit insert 88, and an exit cover plate 89. The track entry top 83 is coupled to the track entry insert 85 and the entry hose carrier 86. The exit cover plate 89 is coupled to the track exit insert 88 and the exit hose carrier 87.

In use, the free end of the length of wire 102 enters the track entry top 83, through a groove cut through the track entry top 83. The free end then passes through a wire slot 91 in the track entry insert 85, through a twister assembly (not shown), and into the first straight track segment 50 of the track guide assembly 10. The straight track segments 50 maintain the direction of the free end along the wire guide path 12. The free end is fed into the corner track segments 52 as the free end loops around the wire guide path 12 and continues therealong until the free end is completely fed around the track guide assembly 10. The free end then enters the track entry and exit subassembly 80 and passes through the first wire slot 91 of the track entry insert 85, reentering the twister assembly.

With reference to FIGS. 1 and 3, each of the plurality of the straight inserts 32 and the corner inserts 34 includes a pair of tabs 33 positioned at each end of the straight and corner inserts 32, 34. Each tab 33 includes an aperture 35 extending therethrough, to allow the straight and corner track segments 50, 52 to be coupled to the carrier plate subassembly 40. The straight cover plates 22 of the straight track segment 50 and the corner cover plates 24 of the corner track segments 52 may be spaced apart from the carrier plate subassembly 40 with spacers 73 and coupled to the carrier plate subassembly 40 through fastening means 72, with the apertures 35 allowing the spacers 73 and the fastening means 72 to extend therethrough. In addition, the spacers 73 may advantageously prevent the straight and corner inserts 32, 34 from contacting each other as they move.

With continued reference to FIGS. 1 and 3, the corner inserts 34 further include a center flange 36 adjoining the tabs 33. A pair of guide rollers 39 are coupled to the center flange 36 of the corner insert 34. The guide rollers 39 are advantageously positioned to reduce the friction of the length of wire 102 as it turns around the corner track segments 52. Although the shown embodiment includes a pair of guide rollers 39, any number of guide rollers 39 may be coupled to the center flange 36.

With reference to FIGS. 1, 2, and 3, each of the vertical carrier plates 41, horizontal carrier plate 42, and plurality of corner carrier plates 43 of the carrier plate subassembly 40 includes a carrier groove 46, which is configured to secure the pneumatic hose 82 therein. The entry hose carrier 86 and the exit hose carrier 87 also include an entry carrier groove 93 and an exit carrier groove 94, respectively, to secure the pneumatic hose 82 therein. As best seen in FIG. 2B, a hose adapter 95 is coupled to the entry hose carrier 86, which includes a hose fitting 96 coupled thereto. The hose fitting 96 may include a quick exhaust valve for quickly releasing pressure when pneumatic pressure supply is removed. The hose fitting 96 is coupled to a regulated pressure source 98 in a known manner. The pneumatic hose 82 is coupled to the hose adapter 95, as the pneumatic hose 82 enters the track guide assembly 10 and passes through the cover carrier subassembly 40, along the wire guide path 12. The pneumatic hose 82 terminates as it reaches the exit hose carrier 87, which is secured by a hose clamp 97. Although in the embodiment shown a pneumatic hose 82 is used, an individual of ordinary skill in the relevant art, having reviewed this entire disclosure, will immediately appreciate that other pressure conduits, such as tubes, pipes, or the like, may be used in lieu of the pneumatic hose 82.

Figure 3A:
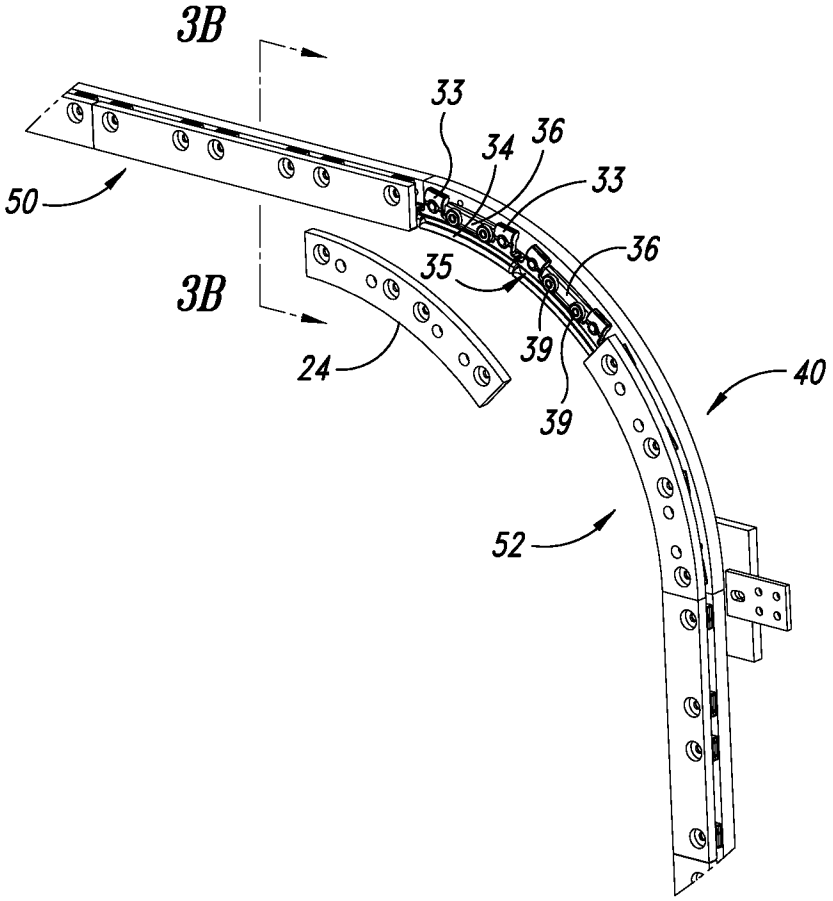
FIG. 3A is a partial isometric view of the track assembly of FIG. 1.
Figure 3C:
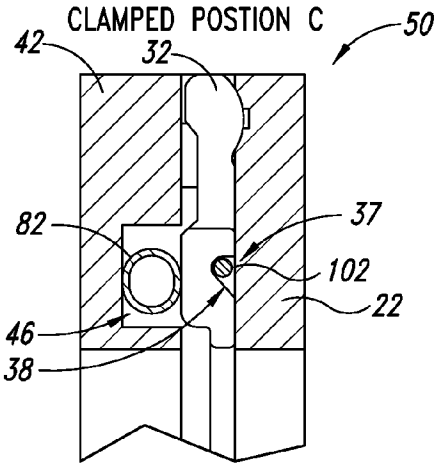
FIG. 3C is a partial cross-sectional view of the track assembly shown in FIG. 3B, showing the track assembly in a clamped position during a feed cycle.
Figure 3D:
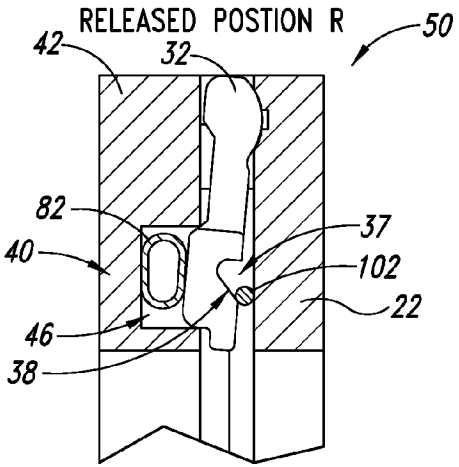
FIG. 3D is a partial cross-sectional view of the track assembly shown in FIG. 3B, showing the track assembly in a position during a tension cycle.
Figure 3B:
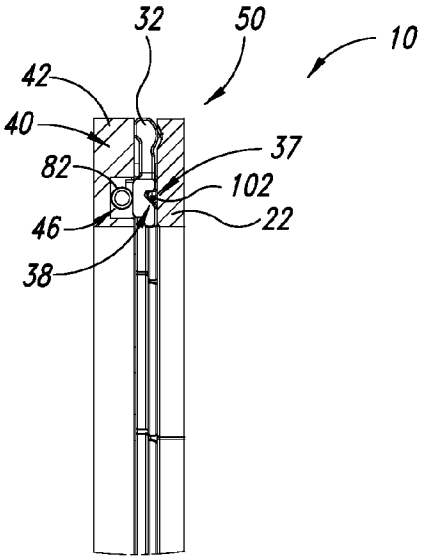
FIG. 3B is a cross-sectional view of the track assembly shown in FIG. 3A, taken along line 3B-3B.

FIGS. 3B, 3C, and 3D are cross-sectional views of the track guide assembly 10, taken along line 3B-3B. FIG. 3C illustrates the track guide assembly 10 in a clamped position C during a feed cycle. During the feed cycle, a fluid in the pneumatic hose 82 is pressurized by the pressure source 98, which results in the pneumatic hose 82 expanding and securing the straight insert 32 against the straight cover plate 22. The straight insert 32 may include a protruding convex surface, which may contact a receiving concave surface of the straight cover plate 22, such that the straight insert 32 is secured to the straight cover plate 22, as the pneumatic hose 82 is pressurized. The straight insert 32 includes an obliquely angled groove 37 that positions the length of wire 102 therein, as the straight insert 32 contacts the straight cover plate 22.

FIG. 3D shows the track guide assembly 10 in a released position R during a tension cycle. During the tension cycle, the fluid in the pneumatic hose 82 is depressurized via a pressure release valve 99, which results in the pneumatic hose 82 contracting to its natural size. As the length of wire 102 is tensioned along an oblique surface 38 of the obliquely angled groove 37, the straight insert 32 pivotally rotates to the released position R, compressing the pneumatic hose 82. In order to allow the straight and corner inserts 32, 34 to pivotally rotate between the released and clamped positions, the apertures 35 of the tabs 33 in the straight and corner inserts 32, 34 are sized to be clearance holes. Further, this displacement releases the length of wire 102 to allow the length of wire 102 to be drawn tightly about the one or more objects to be bundled during the tension cycle. Although FIGS. 3B, 3C, and 3D show cross-sectional views of the straight track segment 50, the corner track segments 52 also operate in similar fashion and are accordingly structured.

Moreover, the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A track system for use in connection with bundling one or more objects positioned within a bundling station, the track system comprising:

a carrier plate subassembly extending around a wire guide path;

a plurality of straight track segments coupled to the carrier plate subassembly;

a plurality of corner track segments coupled to the carrier plate subassembly and the plurality of straight track segments to form a track guide assembly, the track guide assembly substantially enclosing the wire guide path to guide a length of wire about the one or more objects; and a pneumatic system in fluid communication with a regulated pressure source and a pressure release valve and fluidically coupled to the track guide assembly, the pneumatic system being configured to release a pressure to allow the plurality of straight and corner track segments to free the length of wire during a tension cycle and to increase the pressure to fix the plurality of straight and corner segments to secure the length of wire to pass therethrough during a feed cycle, wherein each of the plurality of straight track segments include:

a cover plate; and an insert pivotally coupled to the cover plate and the carrier plate subassembly, the insert having an obliquely angled wire groove configured to secure the length of wire during the feed cycle and to separate the length of wire during the tension cycle.

2. The track system of claim 1 wherein a substantial number of the inserts are of equal length.

3. The track system of claim 1 wherein each of the cover plates is of equal length.

4. The track system of claim 1 wherein each of the plurality of corner track segments includes:

a cover plate; and an insert pivotally coupled to the cover plate and the carrier plate subassembly, the insert having an obliquely angled wire groove configured to secure the length of wire during the feed cycle and to release the length of wire during the tension cycle.

5. The track system of claim 4 wherein the carrier plate subassembly includes a carrier groove to secure a pressure conduit therein, wherein the pressure conduit is in fluid communication with the pressure source and the pressure release valve such that the pressure conduit is configured to be pressurized to fix each of the inserts of the straight track segments and the corner track segments against a respective cover plate of the straight track segments and the corner track segments during the feed cycle, and the pressure conduit is configured to be depressurized to release each of the inserts of the straight track segments and the corner track segments from the respective cover plate of the straight track segments and the corner track segments during the tension cycle.

6. The track system of claim 5 wherein the carrier plate subassembly includes a pair of vertical carrier plates substantially parallel to each other, a horizontal carrier plate oriented substantially perpendicular to each of the vertical carrier plates, and a plurality of corner carrier plates, the corner carrier plates configured to couple the pair of vertical carrier plates to the horizontal carrier plate and to a track entry and exit subassembly.

7. The track system of claim 5 wherein the pressure conduit comprises a pneumatic hose.

8. The track system of claim 4 wherein the insert of the corner track segment includes a roller coupled thereto, the roller being configured to reduce friction along the wire guide path.

* * * * *